US005938108A

United States Patent [19]

Williams et al.

[11] Patent Number: 5,938,108

[45] Date of Patent: Aug. 17, 1999

[54] CHEESE BARREL

[75] Inventors: Daniel J. Williams, Neenah; Paul L. Kaste, Green Bay; Kim A. Hanson, Appleton, all of Wis.

[73] Assignee: Tenneco Packaging, Evanston, Ill.

[21] Appl. No.: 08/764,893

[22] Filed: Dec. 16, 1996

[51] Int. Cl.[6] ..... B65D 5/12

[52] U.S. Cl. ..... 229/109; 229/122.3; 229/125.19

[58] Field of Search ..... 229/23 R, 23 BT, 229/109, 110, 125.19, 125.33, 122.3

[56] References Cited

U.S. PATENT DOCUMENTS

| | | | |
|---|---|---|---|
| 1,430,149 | 9/1922 | Bliss | 229/125.19 |
| 2,766,923 | 10/1956 | D'Esposito | 229/125.33 |
| 2,794,588 | 6/1957 | George et al. | 229/109 |
| 3,465,944 | 9/1969 | Robinson | 229/23 R |
| 3,907,194 | 9/1975 | Davenport et al. | 229/109 |
| 4,042,164 | 8/1977 | Croley | 229/23 BT |
| 5,443,205 | 8/1995 | Robotham et al. | 229/125.19 |

OTHER PUBLICATIONS

Declaration of Dan Williams.

*Primary Examiner*—Gary E. Elkins
*Attorney, Agent, or Firm*—Arnold White Durkee

[57] ABSTRACT

A two- or three-piece barrel container for bulk flowable products and a method of assembling the two- or three-piece barrel container. The two-piece barrel container consists of a body portion and a bottom cap. The body portion includes a plurality of side panels and a plurality of top flaps integrally attached to the top of the side panels. The top flaps are adapted to be folded relative to each other to form a top of the container. The bottom cap includes a plurality of bottom flaps hingedly attached to a bottom hub. The bottom flaps are adapted to be folded upwardly and secured to the bottom end of the container and provide structural support to the bottom end of the container. The three-piece barrel container is similar to the two-piece container except that it includes a body portion, a bottom cap and a separate top cap with a plurality of top flaps adapted to be folded inwardly to form the top of the container. Both the two- and three-piece barrel containers are adapted to be machine assembled in order to reduce production costs.

21 Claims, 7 Drawing Sheets

CHEESE BARREL

FIELD OF THE INVENTION

The present invention relates generally to bulk packaging of flowable products and, more particularly, to bulk packaging of cheese or other suitable products in reinforced corrugated barrels adapted for machine assembly.

BACKGROUND OF THE INVENTION

Bulk product manufacturers are known to use large barrels to hold and transport their products, each barrel being capable of holding up to five hundred pounds of cheese or other bulk flowable product. Several types of barrels are known in the art for packaging these bulk products, including steel barrels, government fiber drums or corrugated cardboard barrels. Among the prior art barrels, the corrugated cardboard barrels are the least expensive, require the least amount of shipping and/or storage space, and are easily disposed of.

One popular type of corrugated cardboard barrel is designed to be formed into an octagon shape to facilitate efficient stacking of the barrels. Typically, the barrels are provided to the cheese manufacturer (hereinafter "customer") in bundles of flat cardboard "blanks" which must be manually set-up by the customer to form upright barrels suitable for storing the customer's product. The customer typically sets up the barrels by folding the blank along eight vertical score lines to form the eight sides of the octagonally-shaped barrel, inserting an octagonal pad between the sides of the barrel to hold it open, forming the bottom of the barrel by folding and snap-locking the bottom flaps into place, turning over the barrel and then inserting liners into the barrels. The barrels are typically set-up several at a time and then "staged", or stored in the factory or warehouse until they are ready to be filled with cheese or other flowable products. After the barrels are filled with the customer's product, the customer must hand-seal the containers with either tape or glue.

The present system of cheese packaging is time consuming, requiring the customer's employees to expend several manhours of labor that could be more productively allocated to other tasks. The process of manually setting up the cheese barrels also inevitably results in a certain amount of employee injuries and accidents which unnecessarily add to the customer's labor costs. Moreover, the process of staging barrels associated with the present system creates an inefficient use of factory or warehouse space inasmuch as the space utilized to stage the barrels could potentially be allocated to more productive uses. Each of these problems either directly or indirectly results in increasing the customer's production costs.

The present invention is directed to overcoming or at least reducing the effects of one or more of the problems set forth above by providing a novel cheese barrel design that is adapted for machine assembly. The cheese barrel eliminates the bottom pad associated with the prior art and reinforces the bottom of the cheese barrel to provide added burst strength and added stacking strength. Because of the increased strength associated with the present invention, the cheese barrel may be manufactured using cardboard having less weight than prior art corrugated cheese barrels. Moreover, the cheese barrel according to the present invention is adapted for machine assembly, which enables labor and production costs to be reduced below that of present systems.

SUMMARY OF THE INVENTION

In accordance with one aspect of the present invention, there is provided a three-piece barrel container for bulk flowable products and a method of forming the container. The three-piece container comprises a body portion, a bottom cap and a top cap. The body portion includes a plurality of side panels hingedly connected and folded relative to each other to form a corresponding plurality of sides of the container with an opening therebetween, each of the sides of the container including a bottom end and a top end. The bottom cap includes a plurality of bottom flaps hingedly attached to a bottom hub. Each of the bottom flaps are folded upwardly and secured to the bottom end of the container to provide structural support to the bottom end of the container. The top cap includes a plurality of top flaps hingedly connected to a top hub. Each of the top flaps are folded downwardly and secured to the top end of the container.

In accordance with another aspect of the present invention, there is provided a two-piece barrel container for bulk flowable products and a method of forming the container. The two-piece container comprises a body portion and a bottom cap. The body portion includes a plurality of side panels and a plurality of top flaps. Each of the plurality of side panels are folded relative to each other to form a corresponding plurality of sides of the container having an opening therebetween. Each of the plurality of top flaps are integrally attached to the top end of a respective one of the plurality of side panels and are adapted to be folded relative to each other to form a top of the container. The bottom cap is substantially the same as the bottom cap of the three-piece container.

BRIEF DESCRIPTION OF THE DRAWINGS

The foregoing and other advantages of the invention will become apparent upon reading the following detailed description and upon reference to the drawings in which.

Figures 1A, 1B:
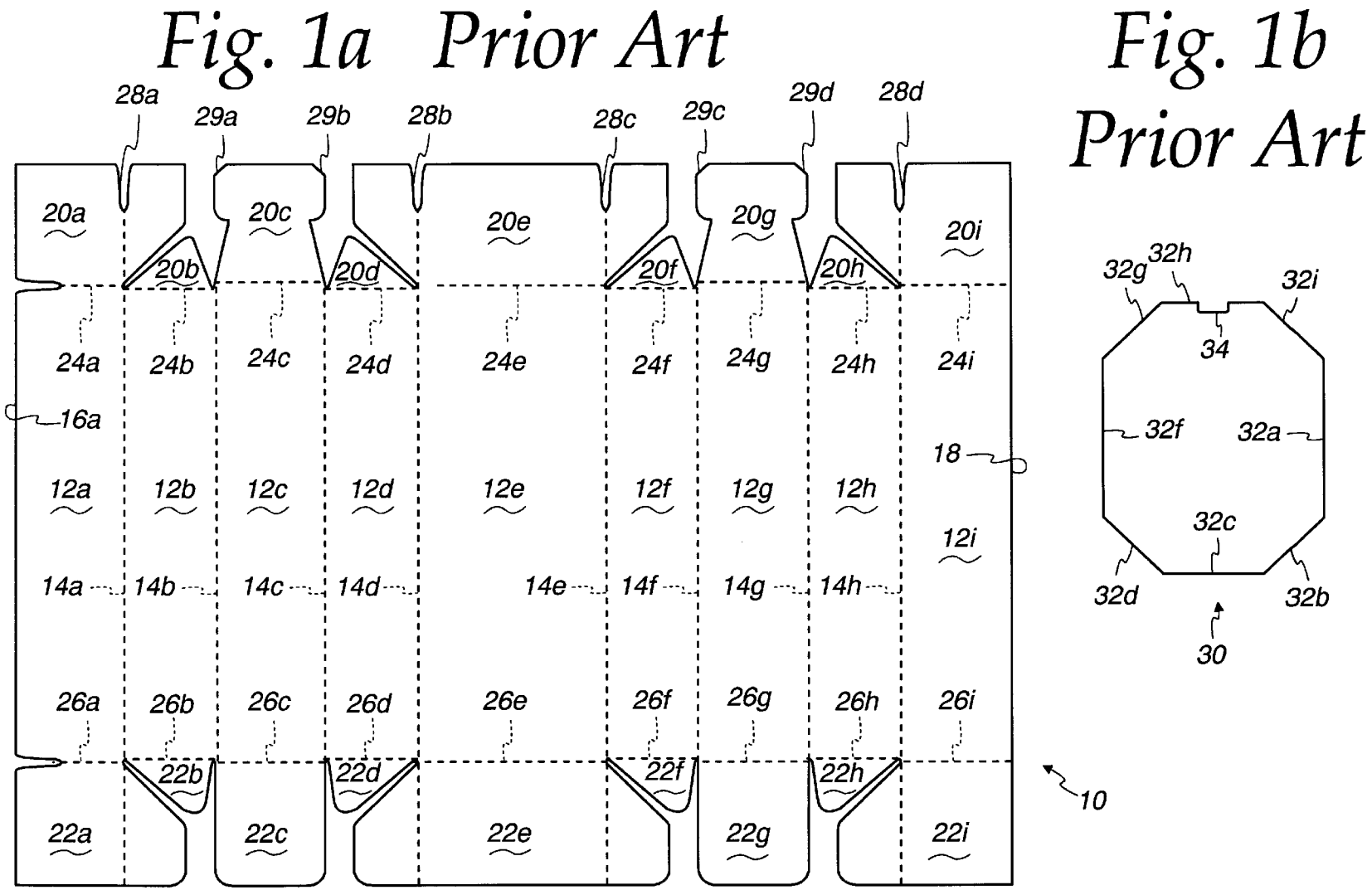
Fig. 1b Prior Art
Fig. 1a Prior Art
FIG. 1*a* is a top view of a blank used to form the prior art octagonal cheese barrel.
FIG. 1*b* is a top view of a bottom pad used in assembling the prior art octagonal cheese barrel.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1*a,* there is depicted a blank 10 from which the prior art octagonal cheese barrel may be formed. The blank 10 is constructed of 500 lb. double-wall corrugated cardboard. The blank 10 is comprised of nine consecutively joined rectangular panels 12*a*–12*i* which are hingedly connected to each other along eight vertical score lines 14*a*–14*h*. The side panels 12*a* through 12*i* also generally include five or six strands of sesame tape (not shown) to reinforce the bottom end of the barrel. The two outer panels 12*a* and 12*i* have free outer edges 16 and 18, respectively. The two outer panels 12*a* and 12*i* are adapted to overlap each other and be glued together to form one side, hereinafter designated side 12*ai*, of the octagonal (eight-sided) cheese barrel. The other seven sides of the octagonal cheese barrel correspond to the side panels 12*b* through 12*h*. As shown in FIG. 1*a*, the side panels do not have equal widths, but are designed to correspond in width to their opposing side panels after the blank 10 has been folded into its octagonal shape. Thus, after the blank 10 is folded into its octagonal shape, side panel pairs 12*b* and 12*f*, 12*c* and 12*g*, 12*d* and 12*h* and 12*e* and 12*ai* comprise respective opposing sides of the container and have corresponding equal widths.

The blank 10 associated with the prior art cheese barrel further includes nine bottom flaps 20*a* through 20*i* and nine top flaps 22*a* through 22*i*. The bottom flaps 20*a* through 20*i* are hingedly attached to an associated one of the side panels 12*a* through 12*i* along respective score lines 24*a* through 24*i*, while the top flaps 22*a* through 22*i* are hingedly attached to an associated one of the side panels 12*a* through 12*i* along respective score lines 26*a* through 26*i*. When the outer edges 16 and 18 of the blank 10 are overlapped and glued together, the two outer bottom flaps 20*a* and 20*i* and the two outer top flaps 22*a* and 22*i* combine to form one bottom flap 20*ai* and one top flap 22*ai*, respectively, in a manner similar to that described in relation to the two outer panels 12*a* and 12*i*. Thus, after the blank 10 is folded into its octagonal shape, there are eight bottom flaps and eight top flaps, each hingedly connected to an associated one of eight side panels.

The bottom and top flaps are designed to be folded inwardly to form the bottom and top, respectively, of the prior art octagonal cheese barrel. The bottom flaps include four small flaps 20*b*, 20*d*, 20*f* and 20*h*, two large flaps 20*ai* and 20*e*, and two medium flaps 20*c* and 20*g*. Notches 28*a*, 28*b*, 28*c* and 28*d* are cut into the two larger flaps 20*ai* and 20*e*, while corresponding tabs 29*a*, 29*b*, 29*c* and 29*d* extend outwardly from the two medium flaps 20*c* and 20*g*. As will be described in detail hereinafter, the tabs 29*a* through 29*d* are adapted to be inserted into the corresponding notches 28*a* through 28*d* during assembly of the barrel. The top flaps include four small flaps 22*b*, 22*d*, 20*f* and 20*h*, two large flaps 22*ai* and 22*e*, and two medium flaps 22*c* and 22*g*. After the blank 10 is folded into its octagonal shape, corresponding bottom flaps 20*b* and 20*f*, 20*c* and 20*g*, 20*d* and 20*h* and 20*e* and 20*ai* are located on opposing sides of the container, as are corresponding top flaps 22*b* and 22*f*, 22*c* and 22*g*, 22*d* and 22*h* and 22*e* and 22*ai*.

Now referring to FIG. 1*a*, there is depicted a bottom pad 30 used in assembling the prior art cheese barrel. The bottom pad 30 comprises an octagonal-shaped piece of 275 lb. double-wall corrugated cardboard with eight sides 32*a* through 32*i*. As will be described in detail hereinafter, the bottom pad 30 is required to be inserted between the sidewalls of the prior art cheese barrel during assembly. The sides 32*a* through 32*i* of the bottom pad 30 thereafter frictionally engage with the sidewalls of the cheese barrel to maintain the cheese barrel in an open position. The bottom pad 30 further includes a hand notch 34 on one of the sides 32*h* to enable an assembler to more efficiently place the bottom pad 30 within the barrel.

Figure 2A:
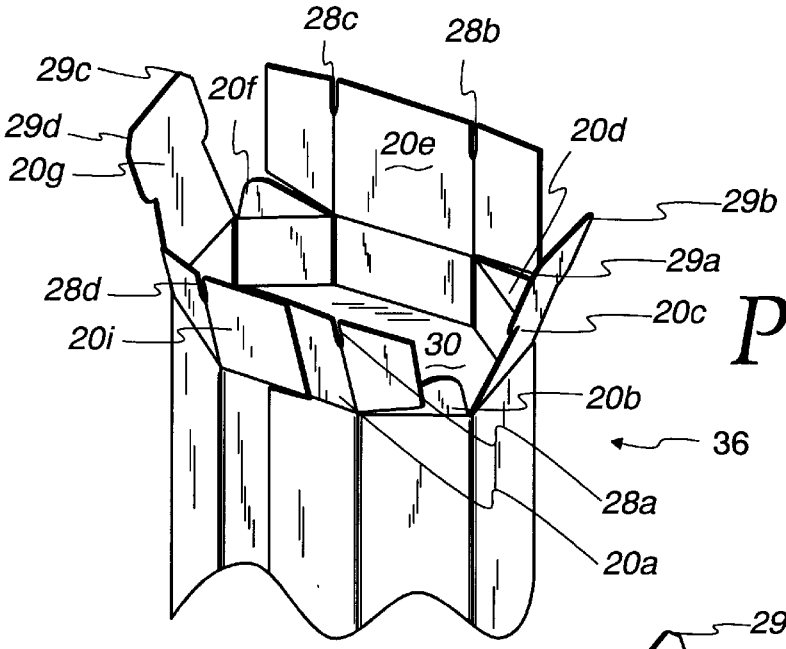
Fig. 2a Prior Art
FIGS. 2*a*–2*c* are perspective views illustrating the steps required to assemble the prior art cheese barrel from the blank of FIG. 1 and bottom pad of FIG. 2.
Figure 2B:
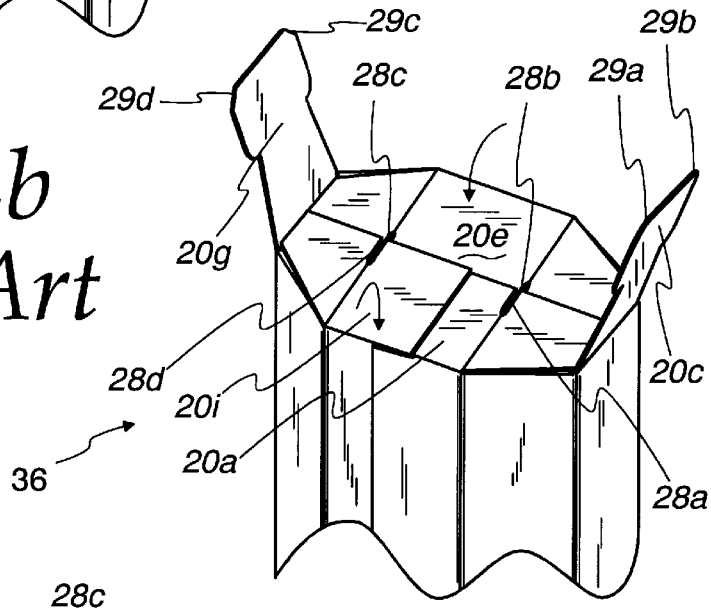
Fig. 2b Prior Art
Figure 2C:
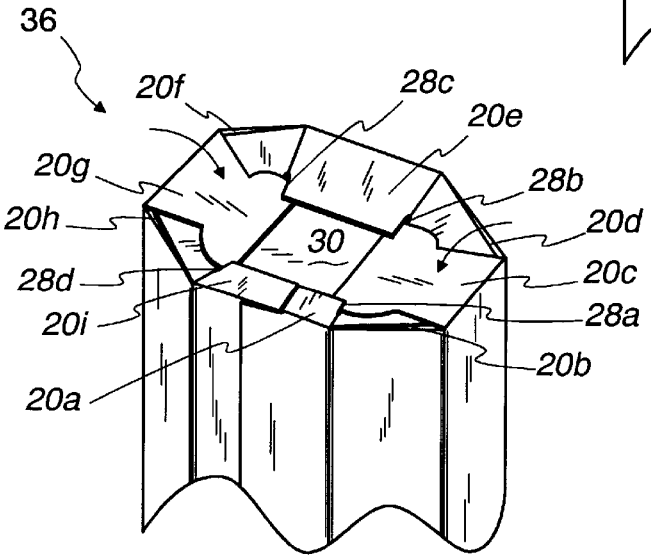
Fig. 2c Prior Art

Turning now to FIGS. 2*a*–2*c*, there will be described the steps required to assemble the prior art cheese barrel from the blank of FIG. 1*a* and bottom pad of FIG. 1*b*. After the outer edges 16 and 18 of the blank 10 (FIG. 1*a*) have been glued together, the barrel 36 is opened such that the eight vertical score lines 14*a* through 14*h* comprise respective edges of the barrel 36. The barrel 36 is then inverted such that the bottom flaps 20 are positioned above the body of the barrel 36. The bottom pad 30 of FIG. 1*b* is then inserted between the side panels 12 of the barrel 36. The bottom pad 30 acts as a mandrel to maintain the barrel 36 in an open position. Then, the four smallest bottom flaps 20*b*, 20*d*, 20*f* and 20*h* are folded in, followed by the two largest bottom flaps 20*ai* and 20*c*. Next, the remaining two bottom flaps 20*c* and 20*g* are folded over the two largest bottom flaps 20*ai* and 20*c*. The bottom of the barrel 36 is then locked into place by inserting the tabs 29*a* through 29*d* extending outwardly from the bottom flaps 20*c* and 20*g* into corresponding notches 28*a* through 28*d* formed in the bottom flaps 20*ai* and 20*c*.

Thereafter, the barrel 36 is turned over so that the top flaps 22 are positioned above the body of the barrel 36. The top flaps are then folded backwardly so that the barrel 36 may be made ready for filling with cheese or other bulk flowable product. The barrels are typically set-up several at a time and then "staged", or stored in the factory or warehouse until they are ready to be filled with cheese or other flowable products. After the barrel 36 is filled, the top of the container is closed by folding in the four smallest top flaps 22*b*, 22*d*, 22*f* and 22*h*, followed by the two largest top flaps 22*ai* and 22*c* and then the two remaining top flaps 22*c* and 22*g*. Typically, the top of the barrel 36 is then sealed with tape or glue.

Figure 3A:
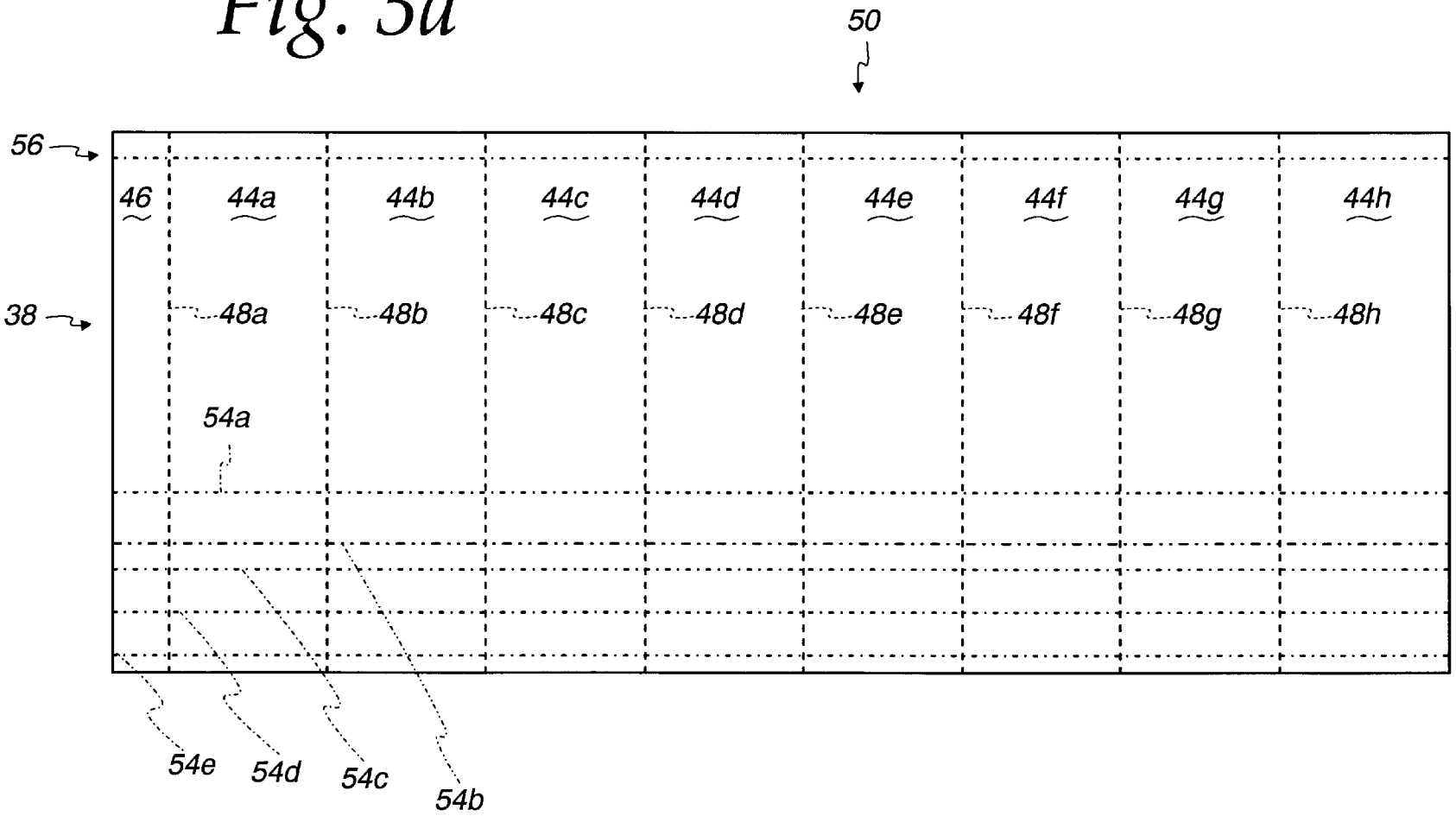
FIGS. 3*a*–3*c* are top views of blanks which may be used to form a three-piece cheese barrel according to one embodiment of the present invention.
Figure 3B:
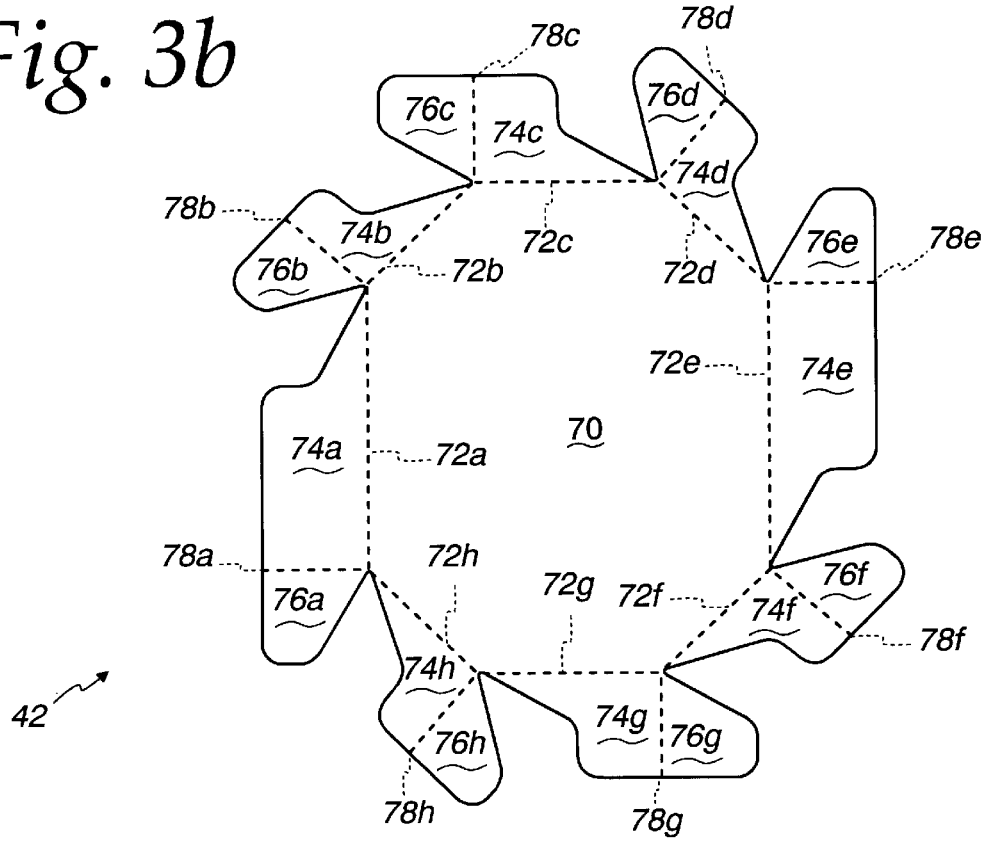
Figure 3C:
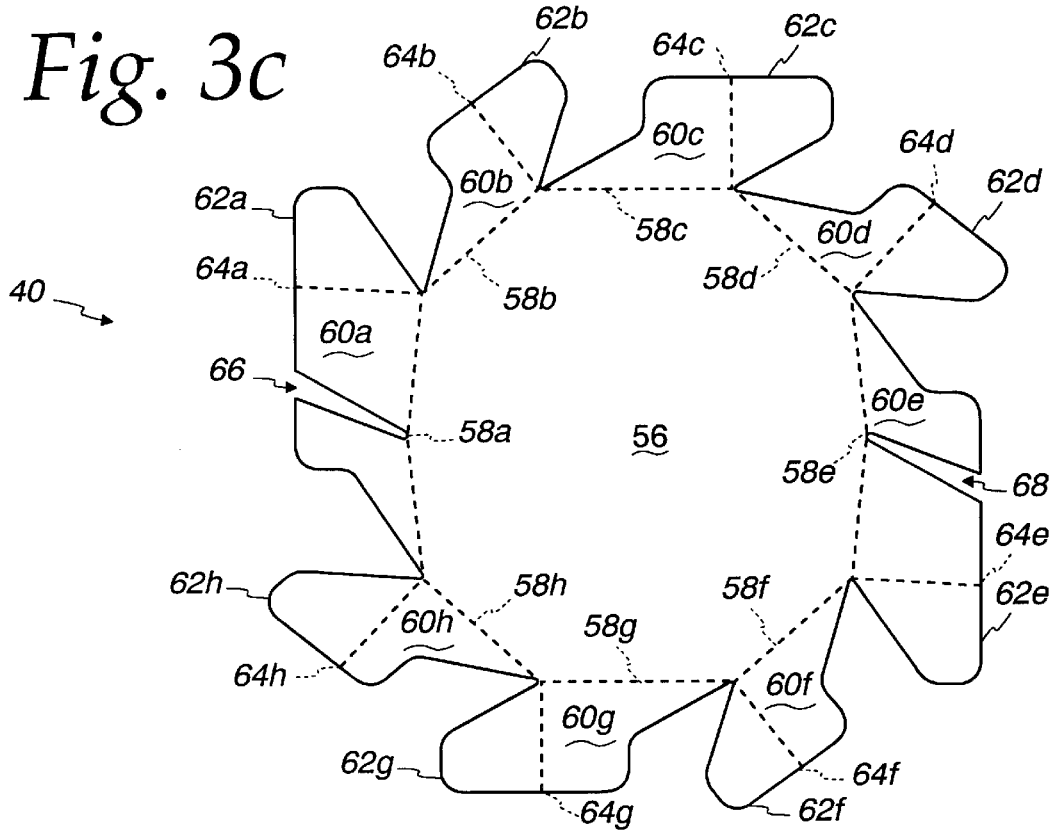

Now turning to FIGS. 3*a*, 3*b* and 3*c*, there are depicted three respective blanks 38, 40 and 42 which may be used to form a three-piece cheese barrel according to one embodiment of the present invention. The blank 38 comprises a "barrel flat" adapted to form the body of the barrel, the blank 40 comprises a "top flat" adapted to form the top of the barrel, and the blank 42 comprises a "bottom flat" adapted to form the bottom of the barrel. Preferably, the blanks 38, 40 and 42 are constructed of 500 lb. double-wall corrugated cardboard, so that the completed cheese barrel will be capable of holding and supporting up to 500 pounds of cheese or other bulk flowable product. Nevertheless, it will be appreciated that the blanks 38, 40 and 42 may be constructed of any suitable material known in the art.

Referring initially to FIG. 3*a*, the barrel flat 38 is comprised of eight consecutively joined rectangular side panels 44*a* through 44*h* and a glue flap 46. The eight side panels 44*a* through 44*h* are hingedly connected to each other along eight vertical score lines 48*a* through 48*h*. The top edge of the barrel flat 38 is designated by reference numeral 50 and the bottom edge is designated by reference numeral 52. Several strands of sesame tape or other suitable reinforcing material, designated by reference numerals 54*a* through 54*e*, are provided near the bottom edge 52 of the barrel flat 38 to reinforce the bottom end of the barrel. An additional strand of sesame tape 56 is provided near the top edge 50 of the barrel flat 38. The glue flap 46 is adapted to be folded over and adhered to the side panel 44*h*. Thereafter, the side panels 44*a* through 44*h* of the barrel flat 38 are adapted to be folded together to form a substantially cylindrical barrel having an octagonal cross section.

The octagonal cross section facilitates efficient stacking of the completed barrels, as in the prior art. However, it will be appreciated that the barrel flat 38 may be comprised of any number of side panels adapted to be curved and/or folded together to form a substantially cylindrical barrel. Moreover, the side panels may have unequal widths, similar to the side panels 12 of the prior art cheese barrel. Finally, it will be appreciated that the barrel flat 38 may include greater or fewer numbers of reinforcing strands than shown in FIG. 3*a*.

A bottom flat 42 according to one embodiment of the present invention is shown in FIG. 3*b*. The bottom flat 42 is preferably made of single-wall B-flute corrugated cardboard, but it will be appreciated that the bottom flat 42 may be made of any suitable material known in the art. The bottom flat 42 is comprised of a bottom hub 70 having a perimeter composed of eight sides, 72*a* through 72*h*, corresponding to the eight sides of an octagonal barrel. The number of sides of the bottom hub 70 correspond to the number of side panels of the barrel flat 38. Thus, it will be appreciated that the bottom flat 42 may have any number of sides, corresponding to the number of sides of the barrel flat 38 described in relation to FIG. 3*a*. Similarly, the sides 72*a* through 72*h* of the bottom hub 70 are designed to correspond in width to the side panels of the barrel flat 38. A plurality of bottom flaps 74*a* through 74*h* extend outwardly from corresponding sides 72*a* through 72*h* of the bottom hub 70. In the embodiment shown in FIG. 3*b*, the bottom flaps 74*a* through 74*h* each include respective wing portions 76*a* through 76*h* attached along respective score lines 78*a* through 78*h*.

The bottom flaps 74 and wings 76 are designed to be folded upwardly and adhered to one or more of the side panels of the barrel to secure the bottom flat 42 to the barrel. More specifically, after the bottom flaps 74 and wings 76 are adhered to the side panels of the barrel, a base portion of the bottom flaps 74 will overlap with the side panel positioned immediately above it, while the wing portions 76 of the bottom flaps will overlap with the next adjacent side panel. In combination, the bottom flaps 74 and wings 76 thus provide a second layer of structural support to the sides of the barrel at the bottom of the barrel, creating a barrel with greater burst strength and greater stacking strength than the one-piece prior art barrel.

A top flat 40 according to one embodiment of the present invention is shown in FIG. 3*c*. Similarly to the bottom flat 42 described in relation to FIG. 3*b*, the top flat 40 is comprised of a top hub 56 having a perimeter composed of eight sides, 58*a* through 58*h*, corresponding to the eight sides of an octagonal barrel. The number of sides of the top hub 56 corresponds to the number of side panels of the barrel flat 38. Thus, it will be appreciated that the top flat 40 may have any number of sides, corresponding to the number of sides of the barrel flat 38 described in relation to FIG. 3*a*. The top flat 40 further comprises a plurality of top flaps 60*a* through 60*h* extending outwardly from corresponding sides 58*a* through 58*h* of the top hub 56. In the embodiment shown in FIG. 3*c*, the top flaps 60*a* through 60*h* each include respective wing portions 62*a* through 62*h* attached along respective score lines 64*a* through 64*h*. The top flaps 60 and wings 62 are designed to be folded downwardly and adhered to one or more of the side panels of the barrel to secure the top flat 40 to the barrel in substantially the same manner as the bottom flat 42 described in relation to FIG. 3*b*. One difference, however, is that the top flaps 58*a* and 58*e* have material cut away to define two respective notches 66 and 68. Because the barrel has a tendency to bow outwardly at its top end after being filled with the bulk flowable product, the notches 66 and 68 enable the top edges 58*a* and 58*e* of the top hub 56 to bow outwardly so that the top flat 40 more easily conforms to the shape of the filled barrel.

As will be appreciated by those skilled in the art, the top and bottom flats 40 and 42 may comprise any of several alternative configurations without departing from the spirit and scope of the present invention. For example, the wings 62 or 76 may be elongated or reduced in size as desired to provide a greater or lesser degree of support to the top or bottom of the barrel. Similarly, the number of wings 62 or 76 may be increased or decreased (or eliminated entirely) as desired to provide a greater or lesser degree of support to the top or bottom of the barrel. Moreover, a greater or fewer number of notches 66, 68 may be provided in the top flat 40 as needed or desired to conform to the shape of the barrel. Finally, the configuration of the bottom flat 42 need not be the same as the configuration of the top flat 40.

Figure 4:
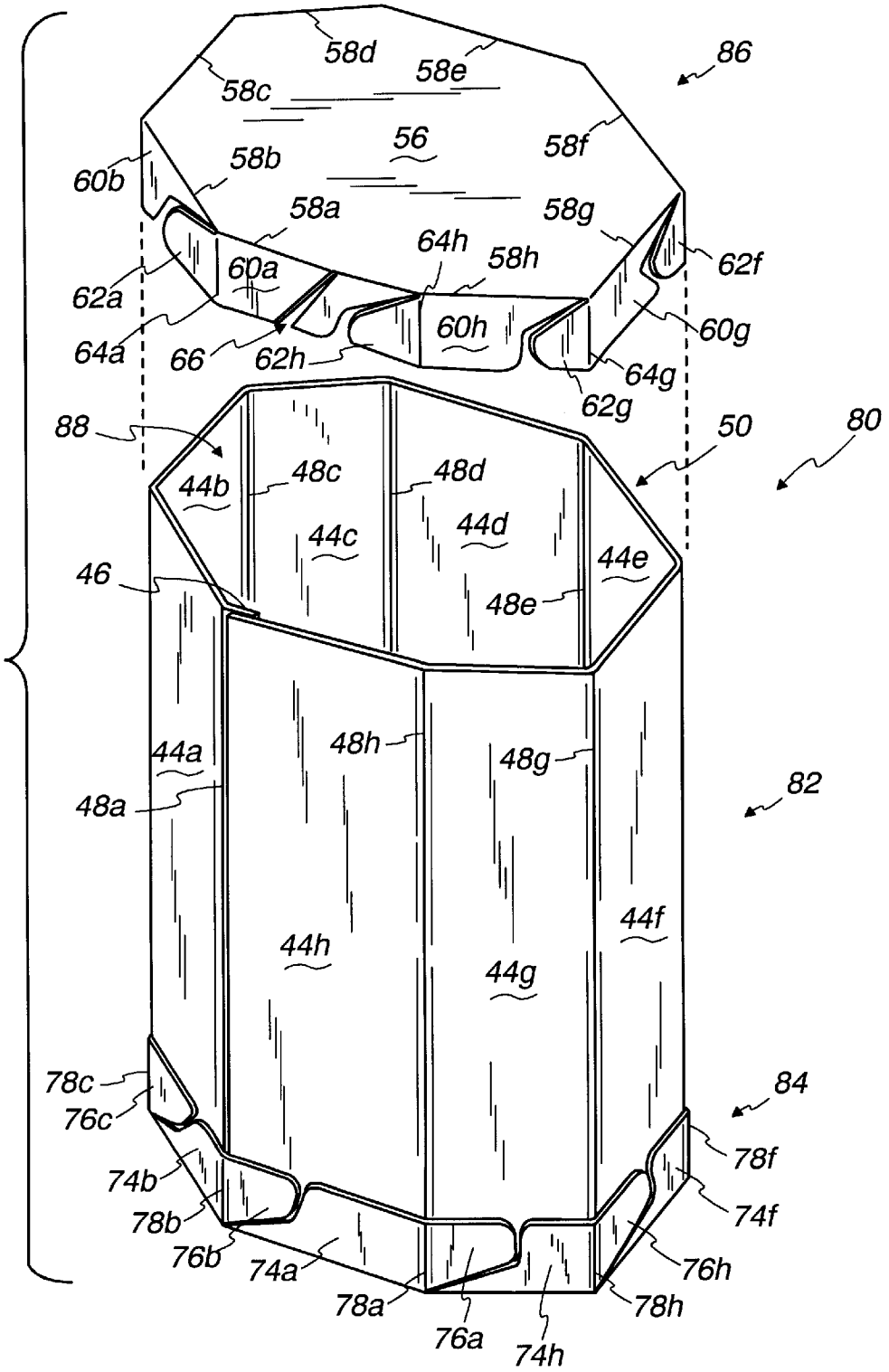
FIG. 4 is a perspective view of a three-piece cheese barrel formed from the blanks of FIG. 3*a*–3*c*.

Now referring to FIG. 4, there is depicted a three-piece barrel container 80 that has been formed from the blanks depicted in FIGS. 3*a*–3*c*. One method of forming the three-piece barrel 80 is described as follows. First, the side panels 44*a* through 44*h* of the blank of FIG. 3*a* are folded relative to each other to form a body portion 82 of barrel container 80. The body portion 82 is substantially cylindrical in shape and has an opening at both its top and bottom ends. After the side panels have been folded together, the glue flap 46 is adhered to an outer edge of side panel 44*h*. The body portion 82 thereafter has an octagonal cross section defined by the eight side panels 44*a* through 44*h* meeting at corners 48*a* through 48*h*. It will be appreciated, however, that the body portion may have any form of polygonal cross section defined by any number of side panels or corners.

After the body portion 82 has been formed, a bottom cap 84 formed from the bottom flat 42 of FIG. 3*b* is applied to enclose the bottom of the body portion 82. This may be accomplished by aligning the bottom flat 42 adjacent to the bottom end of the body portion 82 so that the bottom hub 70 is generally perpendicular to the side panels 44*a* through 44*h* of the body portion 82 and aligned in direct relationship to the octagonal cross section of the bottom end of the body portion 82. At this point, each of the bottom flaps 74*a* through 74*h* will most likely extend outwardly from the bottom hub 70 and be aligned externally to the polygonal cross section of the bottom end of the body portion 82. The bottom flaps 74*a* through 74*h* may then be folded upwardly and adhered to the side panels of the body portion 82.

As shown in FIG. 4, the bottom flaps 74*a* through 74*h* have been secured to the body portion 82 in a manner such that a base portion each of the bottom flaps 74*a* through 74*h* abuts and overlaps with the bottom of an associated side panel 44 of the barrel, the wing portions 76*a* through 76*h* extend upwardly and outwardly from the base portion and abut and overlap with the bottom of the next adjacent side panel 44 of the barrel, and the score lines 78 through 78*h* in the bottom cap 84 overlap with the bottom of an associated corner 48 of the barrel. More specifically, the base portion of bottom flap 74*a* is secured to the bottom of an overhead side panel (44*h* in FIG. 4). The wing portion 76*a* of bottom flap 74*a* extends upwardly and outwardly across corner 48*h* and is secured to the next adjacent side panel 44*g*. The next adjacent bottom flap 74*h* is then secured to its respective overhead side panel 44*g*, its wing portion 76*h* extending across corner 48*g* and secured to the next adjacent side panel 44*f*. This pattern is repeated until the entire bottom cap 84 is secured to the body portion 82. The bottom flaps 74 and associated wings 76 thereby provide a second layer of material around the bottom of the body portion 82 of the barrel, resulting in a barrel having improved burst strength and stacking strength over the prior art barrels.

At this point, assembly of the barrel is substantially complete except for the top portion and it is ready to be lined with plastic or other suitable material to prepare it for filling with the user's product. Generally, the user does not immediately fill the container, but sets aside or "stages" the empty barrel along with other empty barrels at a common location in the factory. Since the staged barrels do not require the bottom pad associated with the prior art, they may be produced at less cost than the prior art. Preferably, the process of assembling the barrels to form empty barrels ready for staging will be completed in less than about two minutes per barrel. Accordingly, it is preferred that the assembly process be accomplished by a machine, inasmuch as manual assembly of the barrel would most likely take longer than two minutes per barrel.

When the barrels are ready to be filled, they are transported from the staging area to a filing area, where they are subsequently filled with cheese or other bulk flowable product. After the barrel is filled, the top cap 86 is designed to be placed over the barrel and secured in substantially the same manner as the bottom cap 84. Of course, it will be appreciated that the manner of assembling the three-piece barrel container 80 will necessarily vary in relation to varying configuration of the bottom cap 84 or top cap 86. For example, as described in relation to FIGS. 3*b* and 3*c,* the wings 62 or 76 may be elongated or reduced in size as desired to provide a greater or lesser degree of support to the top or bottom of the barrel. Similarly, the number of wings 62 or 76 may be increased or decreased (or eliminated entirely) as desired to provide a greater or lesser degree of support to the top or bottom of the barrel. Moreover, a greater or fewer number of notches 66, 68 may be provided in the top flat 40 as needed or desired to conform to the shape of the barrel. Finally, the configuration of the bottom flat 56 need not be the same as the configuration of the top flat 58.

Figure 5:
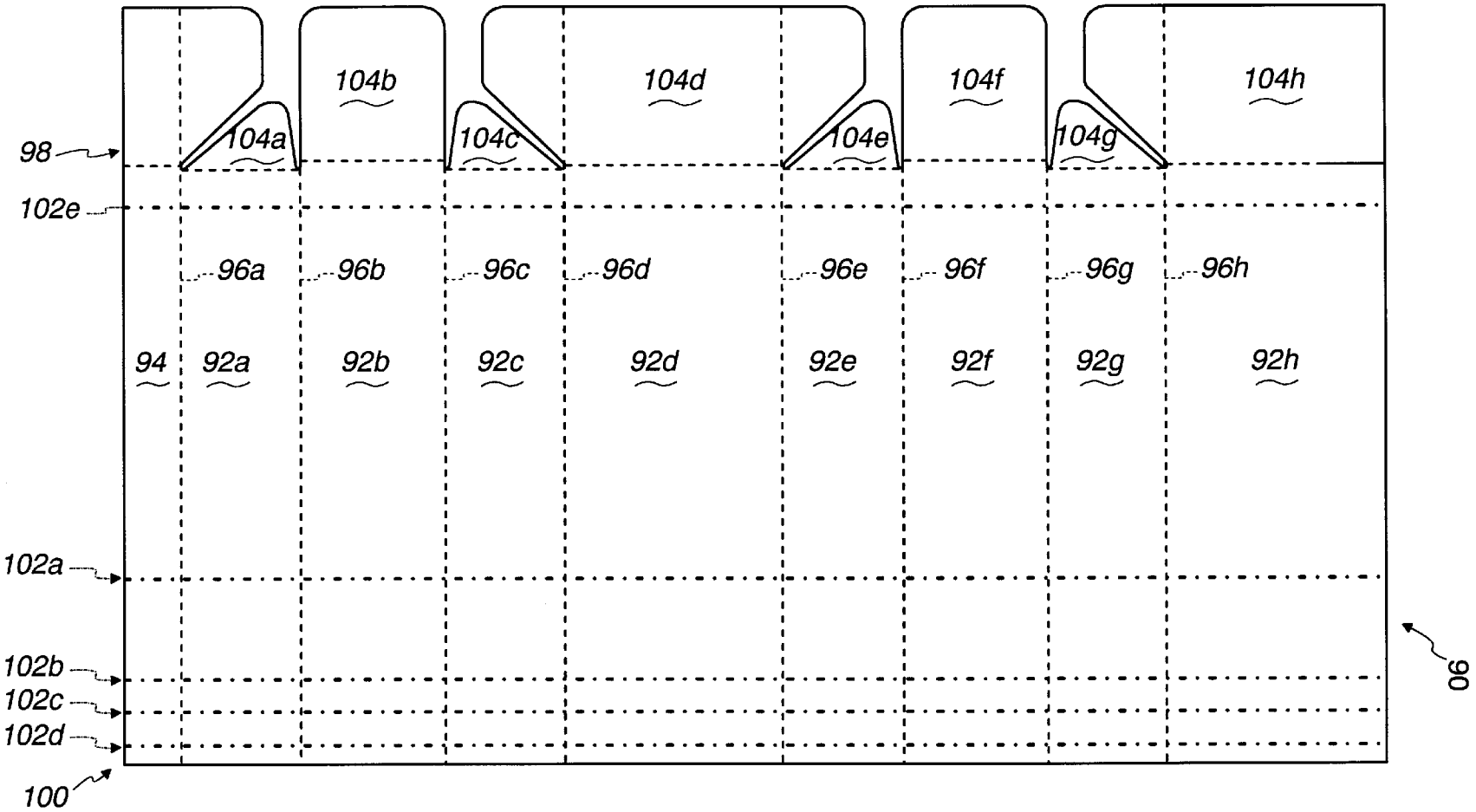
FIG. 5 is a top views of a blank which may be used with the bottom flat of FIG. 3*c* to form a two-piece cheese barrel according to another embodiment of the present invention.

Turning now to FIG. 5, there is shown a blank 90 which may be used to form a two-piece cheese barrel according to another embodiment of the present invention. The blank 90 is adapted to form both the body and top of the barrel, while the bottom of the barrel is designed to be formed from a separate piece such as the blank 42 described in relation to FIG. 3*b*. Preferably, the blank 90 is constructed of 500 lb. double-wall corrugated cardboard and the blank 42 is constructed of single-wall B-flute corrugated cardboard. Nevertheless, the blanks 90 and 42 may be constructed of any suitable material known in the art.

The blank 90 is comprised of eight consecutively joined rectangular side panels 92*a* through 92*h* and a glue flap 94. The eight side panels 92*a* through 92*h* are hingedly connected to each other along eight vertical score lines 96*a* through 96*h*. Eight top flaps 104*a* through 104*h* are integrally attached to the top of the blank 90 along a horizontal score line 98. The bottom edge of blank 90 is designated by reference numeral 100. Several strands of sesame tape or other suitable reinforcing material, designated by reference numerals 102*a* through 102*e,* may be provided to reinforce the barrel in the same manner described in relation to FIG. 3*a*. The glue flap 94 is adapted to be folded over and adhered to the side panel 92*h*. Thereafter, the side panels 92*a* through 92*h* of the blank 90 are adapted to be folded together to form a substantially cylindrical barrel having an octagonal cross section, as in the prior art. However, it will be appreciated that the blank 90 may be comprised of any number of side panels adapted to be curved and/or folded together to form a substantially cylindrical barrel. Moreover, as shown in FIG. 5, the side panels may have unequal widths.

In addition to the blank 90, the two-piece container includes a bottom flat such as the bottom flat 42 shown in FIG. 3*b*. Inasmuch as the bottom flat 42 has been described in detail in relation to FIG. 3*b,* it will not be described hereinafter. Suffice it to say that the bottom flat is designed to both enclose and provide structural support to the bottom of the container in the same manner as in the three-piece container heretofore described.

Figure 6:
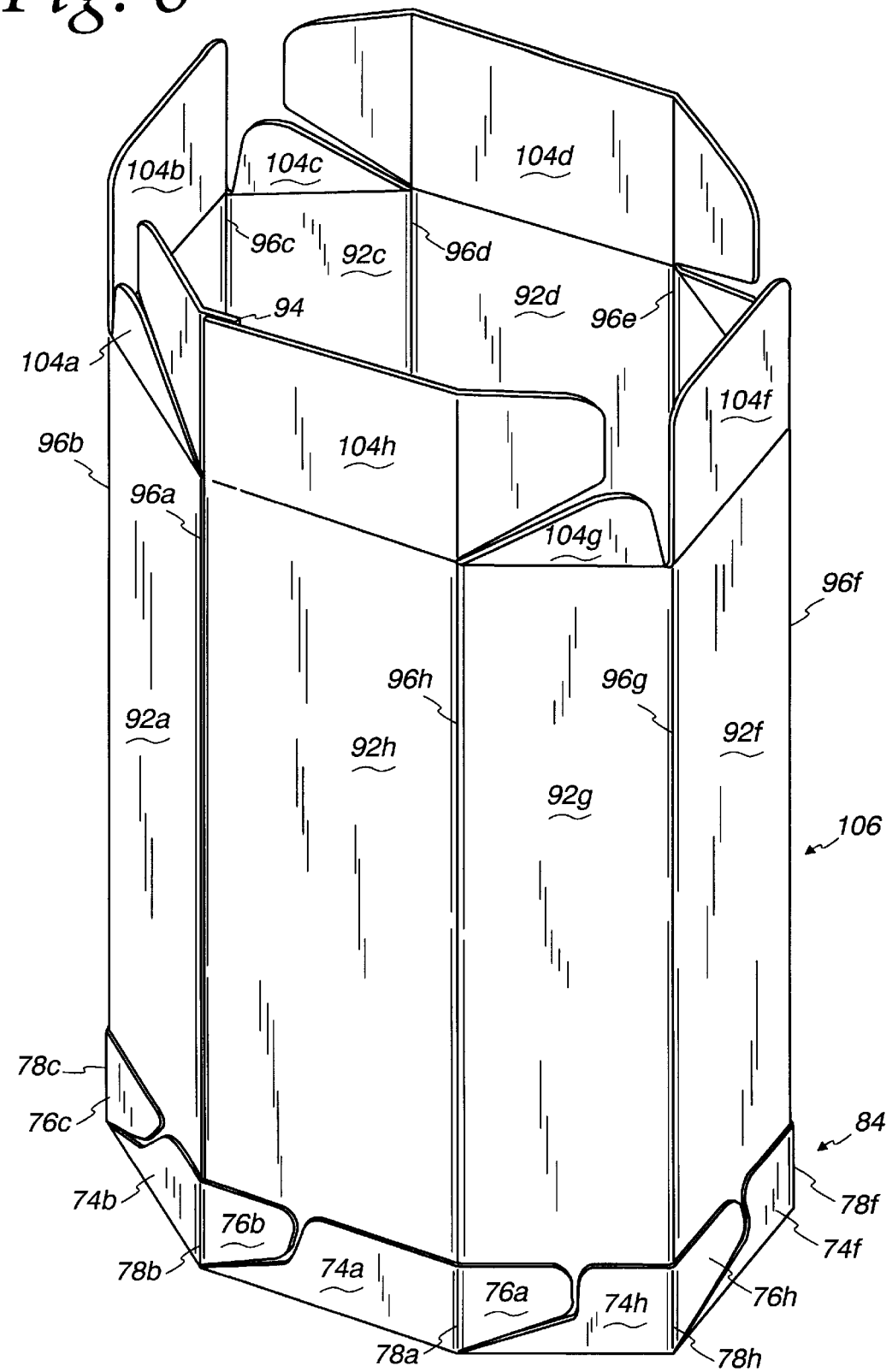
FIG. 6 is a perspective view of a two-piece cheese barrel formed from the blanks of FIG. 5 and FIG. 3*c*.

Now referring to FIG. 6, there is shown a two-piece barrel container 106 that has been formed from the blanks depicted in FIG. 5 and FIG. 3*b*. One method of forming the two-piece barrel 106 is described as follows. First, the side panels 92*a* through 92*h* of the blank 90 of FIG. 5 are folded relative to each other to form both the body and top portion of barrel container 106. After the side panels have been folded together, the glue flap 94 is adhered to an outer edge of side panel 92*h*. The barrel container 106 thereafter has an octagonal cross section defined by the eight side panels 92*a* through 92*h* meeting at corners 96*a* through 96*h*. It will be appreciated, however, that the body portion may have any form of polygonal cross section defined by any number of side panels or corners.

After the side panels 92*a* through 92*h* have been joined together, the bottom cap 84 is applied to enclose the bottom of the container 106 in the same manner described in relation to FIG. 4. The barrel may then be lined with plastic or other suitable material so that it is ready to be filled with cheese or other bulk flowable product at the convenience of the user. Like the three-piece barrel heretofore discussed, the two-piece barrel does not require the bottom pad associated with the prior art and may thereby be produced at less cost than the prior art. Also, similar to the three piece barrel, it is preferred that the two-piece barrels be assembled in less than about two minutes per barrel. Accordingly, it is preferred that the assembly process be accomplished by a machine, inasmuch as manual assembly of the barrel would most likely take longer than two minutes per barrel.

When the barrels are ready to be filled, they are transported from the staging area to a filling area, where they are subsequently filled with cheese or other bulk flowable product. After the barrel is filled, the top flaps 104*a* through 104*h* are designed to be folded down to enclose the container 106, then sealed with tape or glue in the same manner as in the prior art. Specifically, the top of the container 106 is closed by folding in the four smallest top flaps 104*a,* 104*c,* 104*e* and 104*g,* followed by the two largest top flaps 104*h* and 104*d* and then the two remaining top flaps 104*b* and 104*f*.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A set of three unitary blanks of corrugated cardboard material adapted to be formed into a three-piece barrel container for bulk flowable products, comprising:

a barrel flat including a plurality of consecutively joined side panels hingedly connected along transverse score lines, the side panels being adapted for folding relative to each other to form a barrel body defining a plurality of sides meeting at corners and having a polygonal cross-sectional shape generally approximating a cylinder;

a bottom flat including a plurality of bottom flaps hingedly attached to a bottom hub, the bottom flaps being adapted for folding upwardly relative to the bottom hub in non-overlapping relationship with each other to form a bottom of said container, each of the bottom flaps overlapping at least one of the corners of the barrel body when folded to form the bottom of the container; and a top flat including a plurality of top flaps hingedly connected to a top hub, the top flaps being adapted for folding downwardly relative to the top hub to form a top of said container.

2. The set of claim 1 wherein the plurality of side panels includes at least five rectangular side panels.

3. The set of claim 2 wherein the plurality of bottom flaps and the plurality of top flaps are each equal in number to the plurality of side panels.

4. The set of claim 3 wherein the bottom hub includes a perimeter having a plurality of sides corresponding in number to the plurality of side panels, and wherein each of the bottom flaps includes a base portion and a wing portion, the base portion being hingedly attached to a respective one of the sides of the perimeter of the bottom hub, the wing portion extending outwardly from the base portion.

5. The set of claim 1 wherein the plurality of side panels includes eight side panels, wherein the plurality of bottom flaps includes eight bottom flaps, and wherein the plurality of top flaps includes eight top flaps.

6. The set of claim 1 wherein each of the bottom flaps are adapted for folding with a single upward fold.

7. The set of claim 1 wherein each of the bottom flaps are adapted for folding with single upward fold and a single transverse fold.

8. A three-piece barrel container for bulk flowable products comprising:

a body portion including a plurality of side panels hingedly connected and folded relative to each other to form a barrel body defining a plurality of sides meeting at corners, the barrel body having a polygonal cross-sectional shape generally approximating a cylinder, each of the sides including a bottom end and a top end;

a bottom cap forming a bottom of said container, said bottom cap including a plurality of bottom flaps hingedly attached to a bottom hub, each of the bottom flaps being folded upwardly in overlapping relationship with at least one of the corners of the barrel body and secured to the bottom end of an associated one or more sides of the container in non-overlapping relationship to the other flaps to provide structural support to the bottom of said container; and a top cap forming a top of said container, said top cap including a plurality of top flaps hingedly attached to a top hub, each of the top flaps being folded downwardly and secured to the top end of an associated one or more sides of the container.

9. The container of claim 8 wherein said plurality of side panels includes at least five side panels hingedly connected and folded relative to each other to create a substantially cylindrical-shaped container having at least five corners.

10. The container of claim 9 wherein the plurality of bottom flaps and the plurality of top flaps are each equal in number to the plurality of side panels.

11. The container of claim 8 wherein the plurality of side panels includes eight side panels, the plurality of bottom flaps includes eight bottom flaps and the plurality of top flaps includes eight top flaps.

12. The container of claim 8 wherein each of the bottom flaps are folded with a single upward fold.

13. The container of claim 8 wherein each of the bottom flaps are folded with a single upward fold and a single transverse fold.

14. A three-piece barrel container for bulk flowable products comprising:

a body portion including a plurality of at least five side panels, the side panels being hingedly connected and folded relative to each other to form a substantially cylindrical-shaped barrel body with an opening therebetween and having at least five corners, each of the sides including a bottom end and a top end;

a bottom cap forming a bottom of said container, said bottom cap including a plurality of bottom flaps equal in number to the plurality of side panels, each of the bottom flaps being hingedly attached to a bottom hub, each of the bottom flaps being folded upwardly and secured to the bottom end of an associated one or more sides of the container in non-overlapping relationship to the other flaps to provide structural support to the bottom of said container; and a top cap forming a top of said container, said top cap including a plurality of top flaps equal in number to the plurality of side panels, each of the top flaps being hingedly attached to a top hub, each of the top flaps being folded downwardly and secured to the top end of an associated one or more sides of the container, wherein the bottom hub includes a perimeter having a plurality of sides corresponding in number to the plurality of side panels, and wherein each of the bottom flaps includes a base portion and a wing portion, the base portion being hingedly attached to a respective one of the sides of the perimeter of the bottom hub, the wing portion extending upwardly and outwardly from the base portion.

15. The container of claim 14 wherein the wing portion of each of the bottom flaps is folded over and secured to a bottom portion of the container including one of the corners of the container and the bottom end of two adjacent side panels of the container.

16. A three-piece barrel container for bulk flowable products comprising:

a body portion including eight side panels hingedly connected and folded relative to each other to form a corresponding eight sides with an opening therebetween, each of the sides including a bottom end and a top end;

a bottom cap forming a bottom of said container, said bottom cap including eight bottom flaps hingedly attached to a bottom hub, each of the bottom flaps being folded upwardly and secured to the bottom end of an associated one or more sides of the container to provide structural support to the bottom of said container; and a top cap forming a top of said container, said top cap including eight top flaps hingedly attached to a top hub, each of the top flaps being folded downwardly and secured to the top end of an associated one or more sides of the container, wherein two of the top flaps have material cut away to define two respective notches, each of said notches receiving the wing portion of an adjacent top flap when the top flaps are folded downwardly and secured to the bottom of the container.

17. The container of claim 16 wherein the container is constructed of corrugated cardboard.

18. A two-piece barrel container for bulk flowable products comprising:

a body portion including a plurality of at least five side panels and a plurality of top flaps equal in number to the plurality of side panels, said plurality of side panels being hingedly connected and folded relative to each other to form a corresponding plurality of sides with an opening therebetween and defining a substantially cylindrical-shaped container having at least five corners, each of the plurality of side panels having a top end and a bottom end, each of the plurality of top flaps being integrally attached to the top end of a respective one of the plurality of side panels and being folded relative to each other to form a top of the container; and a bottom cap forming a bottom of said container, said bottom cap including a plurality of bottom flaps equal in number to the plurality of side panels, the bottom flaps being hingedly attached to a bottom hub, each of the bottom flaps being folded upwardly and secured to the bottom end of an associated one or more sides of the container in non-overlapping relationship to the other flaps to provide structural support to the bottom of the container, wherein the bottom hub includes a perimeter having a plurality of sides corresponding in number to the plurality of side panels, and wherein each of the bottom flaps include a base portion and a wing portion, the base portion being hingedly attached to a respective one of the sides of the perimeter of the bottom hub, the wing portion extending upwardly and outwardly from the base portion.

19. The container of claim 18 wherein the wing portion of each of the bottom flaps is folded over and secured to a bottom portion of the container including one of the corners of the container and the bottom end of two adjacent side panels of the container.

20. A two-piece barrel container for bulk flowable products comprising:

a body portion including eight side panels and eight top flaps, each of the side panels being folded relative to each other to form a corresponding number of sides with an opening therebetween, each of the side panels having a top end and a bottom end, each of the top flaps being integrally attached to the top end of a respective one of the side panels and being folded relative to each other to form a top of the container, wherein two of the top flaps have material cut away to define two respective notches, each of said notches receiving the wing portion of an adjacent top flap when the top flaps are folded downwardly and secured to the bottom of the container; and a bottom cap forming a bottom of said container, said bottom cap including eight bottom flaps hingedly attached to a bottom hub, each of the bottom flaps being folded upwardly and secured to the bottom end of an associated one or more sides of the container to provide structural support to the bottom of the container.

21. The container of claim 20 wherein the container is constructed of corrugated cardboard.

* * * * *